United States Patent [19]

Spalding

[11] 4,069,693

[45] Jan. 24, 1978

[54] CYLINDER LOCK ASSEMBLY

[76] Inventor: George T. Spalding, Rte. 1, Monroe City, Mo. 63456

[21] Appl. No.: 664,987

[22] Filed: Mar. 8, 1976

Related U.S. Application Data

[63] Continuation-in-part of Ser. No. 536,452, Dec. 26, 1974, abandoned.

[51] Int. Cl.[2] ..... E05B 15/08; E05B 17/18; E05B 29/04

[52] U.S. Cl. ..... 70/364 R; 70/377; 70/453; 70/455

[58] Field of Search ..... 70/352, 364 R, 369, 70/377, 419, 455, 453

[56] References Cited

U.S. PATENT DOCUMENTS

| | | | |
|---|---|---|---|
| 335,648 | 2/1886 | Spencer | 70/364 R |
| 497,640 | 5/1893 | Doremus | 70/455 X |
| 2,024,441 | 12/1935 | Fitzgerald | 70/377 X |
| 2,047,966 | 7/1936 | Jacobi | 70/377 X |
| 2,666,322 | 1/1954 | Uher | 70/419 |
| 2,766,611 | 10/1956 | Hagel | 70/377 |
| 3,206,958 | 9/1965 | Best | 70/369 X |
| 3,287,944 | 11/1966 | Crumb | 70/377 X |
| 3,707,863 | 1/1973 | Schwab | 70/364 R |
| 3,709,006 | 1/1973 | Seidewand | 70/364 R |
| 3,739,611 | 6/1973 | Ignatjer | 70/364 R |

*Primary Examiner*—Robert L. Wolfe
*Attorney, Agent, or Firm*—Fishburn, Gold & Litman

[57] ABSTRACT

A cylinder lock assembly includes a tubular housing rotatably receiving therein an elongated unitary barrel having a configuration suitable for single step diecast fabrication without the extremely complex coring and secondary operations heretofore required. The barrel contains a plurality of easily diecast and assembled, open sided tumblers in face to face sliding engagement, each of which is individually engaged by a finger of a unitary, multi-fingered resilient member for urging the respective tumbler into a locked position until displaced by a key moved transversely through a slot formed in each tumbler. Modified forms include a dust door receiving cavity which has a dust cover integral with the barrel and a dust door closing spring integral with the tumbler contacting resilient member. Also, simplified structures are provided to retain the barrel in the housing.

15 Claims, 23 Drawing Figures

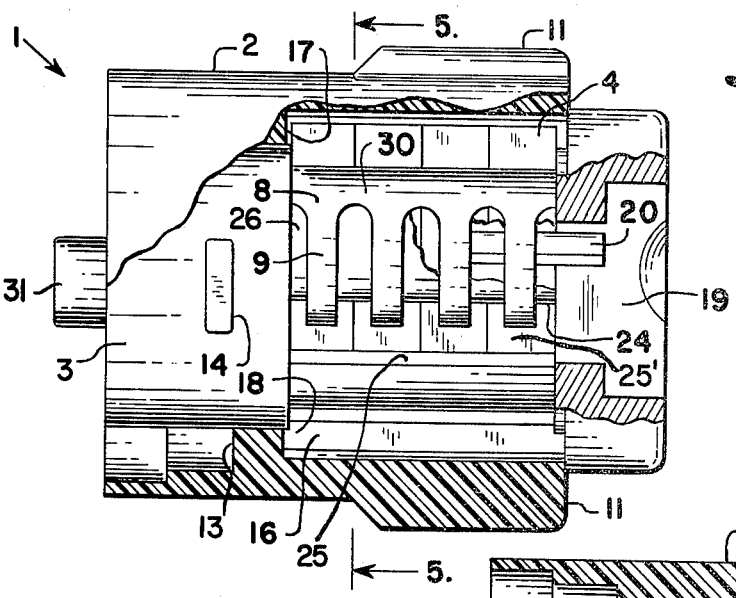
Fig. 1
Fig. 2.
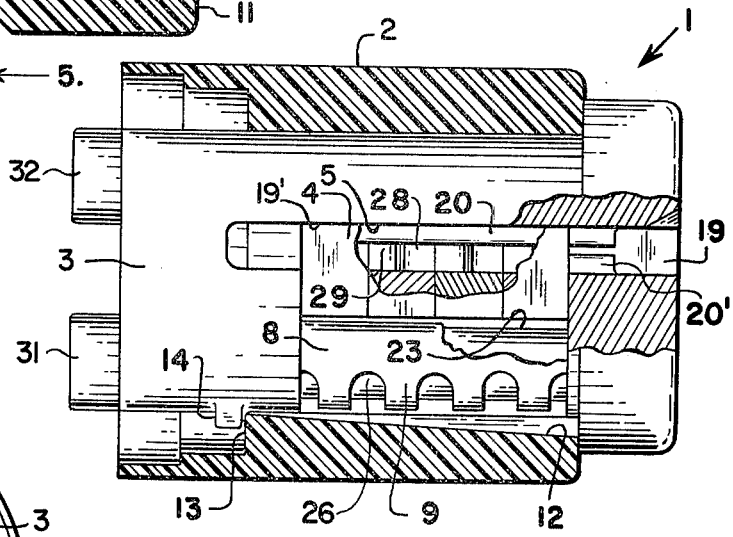
Fig. 3.
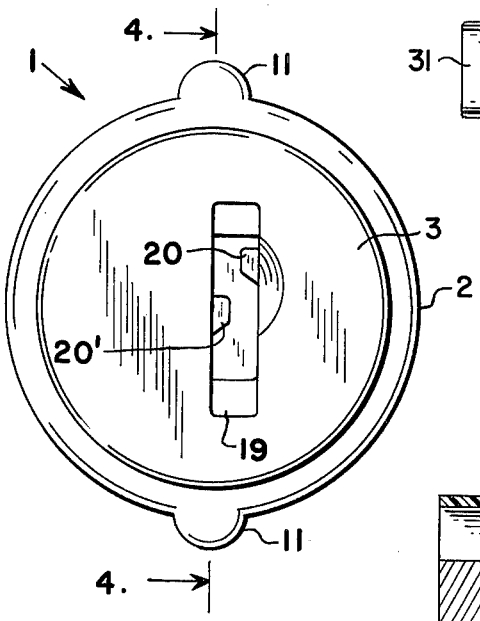
Fig. 4.
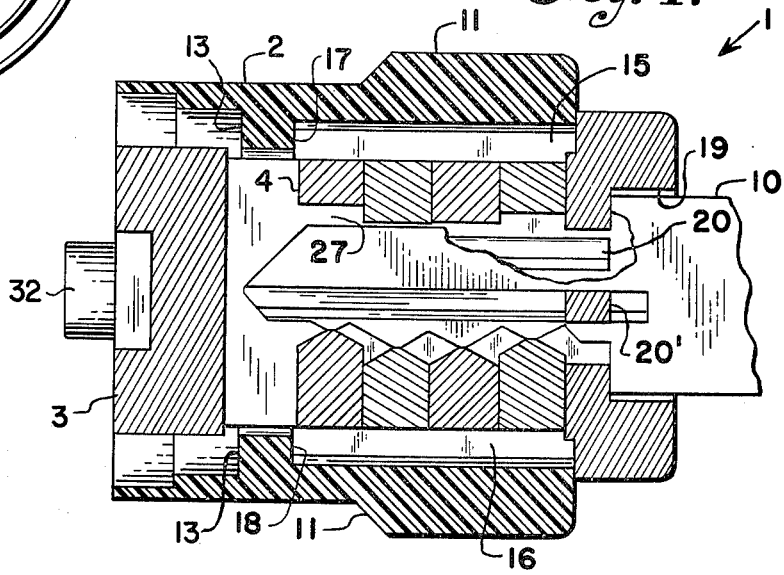

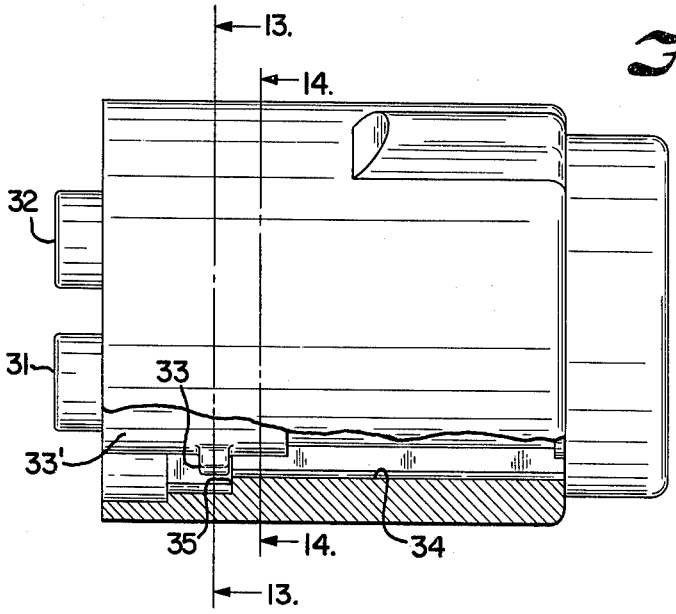
Fig. 12.
Fig. 13.
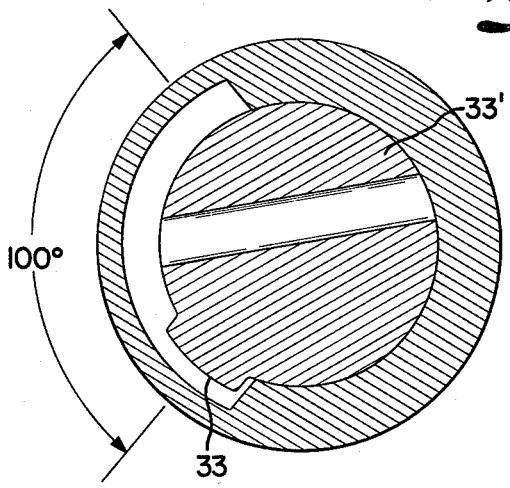
Fig. 14.
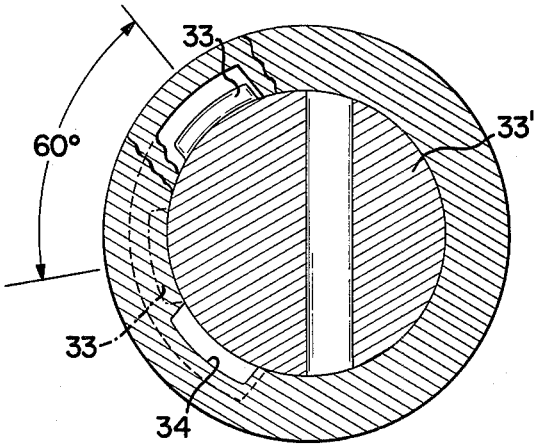

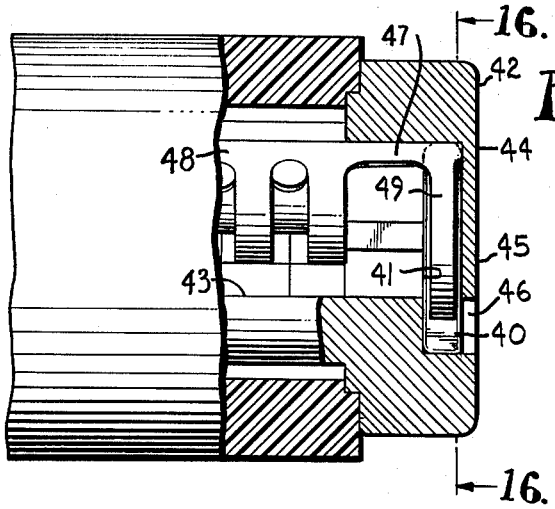
Fig.15.
Fig.16.
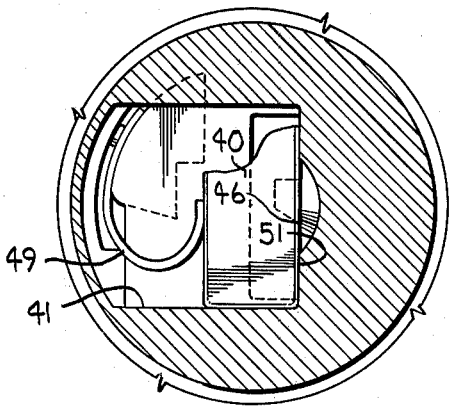
Fig.17.
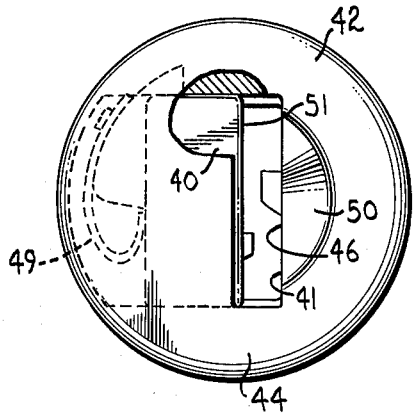
Fig.18.
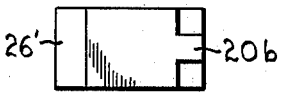

CYLINDER LOCK ASSEMBLY

This is a continuation-in-part of application Ser. No. 536,452, filed Dec. 26, 1974 now abandoned.

The present invention relates to locks and more particularly to tumbler lock assemblies which may be manufactured and assembled at substantially lower cost than heretofore.

Key actuated tumbler lock assemblies are well known, however, due to their complexity and multiplicity of parts, they have been considered necessarily expensive to fabricate. This invention permits various tumbler lock parts to be easily and inexpensively produced and assembled.

The principal objects of the present invention are: to provide a lock assembly having component parts adapted to be easily and inexpensively fabricated and assembled; to provide such a lock assembly including a unitary barrel having a plurality of open-sided tumblers in secure, face to face sliding engagement within a non-compartmented, tumbler slot; to provide such a lock assembly wherein a key guide projection extends along the non-compartmented tumbler slot and is interrupted at spaced intervals to transversely receive guide projections on the tumblers, thereby permitting easy tumbler insertion; to provide such a lock assembly having a barrel supporting a unitary resilient member with fingers or leaves engaging the tumblers to urge them toward a locked position while slidably retained in said slots; to provide such a lock assembly having simple structure for retention of the barrel in the housing and resilient member on the barrel; to provide a lock barrel having a configuration suitable for single step diecast fabrication without the extremely complex coring and secondary operations heretofore required; to provide such a lock barrel having a dust door receiving cavity with an integral dust cover and a dust door closing spring integral with the tumbler spring member; and to provide such a lock assembly which is durable in construction, positive in operation, and particularly well adapted for its intended purpose.

Other objects and advantages of this invention will become apparent from the following description taken in connection with the accompanying drawings wherein are set forth by way of illustration and example certain embodiments of this invention.

FIG. 1 is a side elevational view of a lock assembly embodying features of the present invention with portions broken away to show operative and structural parts thereof.

FIG. 2 is a top plan view of the lock assembly with portions broken away.

FIG. 3 is a front elevational view of the lock assembly.

FIG. 4 is a longitudinal sectional view taken on line 4—4, FIG. 3, showing a key in the lock assembly and the tumblers displaced to an unlocked position.

FIG. 12 is an angular elevation of the lock assembly with a portion broken away showing a modified form of barrel retention in the housing.

FIG. 13 is a transverse sectional view taken on line 13—13, FIG. 12.

FIG. 14 is a transverse sectional view taken on line 14—14, FIG. 12, but modified to indicate extreme positions of the keeper during regular lock operation.

FIG. 15 is a fragmentary side elevational view of a modified form of lock assembly including a dust cover and door.

FIG. 16 is a transverse sectional view taken on the line 16—16, FIG. 15, showing the dust door and cavity.

FIG. 17 is a front elevational view of the lock assembly of FIG. 15.

FIG. 18 is an end plan view of the tumbler of FIGS. 7 and 8.

Figure 5:
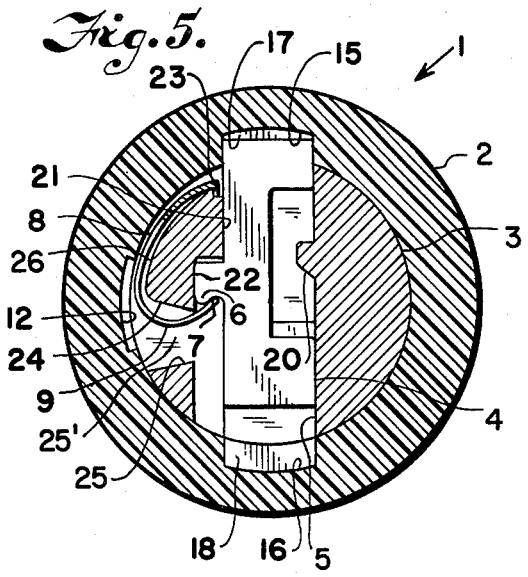
FIG. 5 is a transverse sectional view taken on line 5—5, FIG. 1, showing tumblers in a locked position.

In the disclosed embodiment of the present invention, the reference numeral 1 generally designates a tumbler lock assembly which may be used for any of the well known operations calling for such devices.

The illustrated lock assembly 1 includes a tubular housing 2 having a bore therein rotatably receiving an elongated, unitary barrel 3, suitable for diecast fabrication. The term "unitary" as used herein is intended to mean that, in this example, at least the major part of the barrel is fabricated in one piece, rather than made of stacked or separately assembled portions. A plurality of tumblers 4 are positioned in face to face sliding engagement within a non-compartmented slot 5 formed in the barrel 3. The tumblers 4 are also suitable for diecast fabrication and each have, in this example, a projection 6 extending from one edge and intermediate the ends thereof and shaped to form a recess 7.

A resilient tumbler biasing member or spring 8 is mounted on the barrel 3 and has a plurality of arms or fingers 9 each engaging a respective one of the projections 6 for urging the tumblers 4 into a locked position until engaged by a portion of a key 10 moved transversely through a slide-open keyway in each tumbler 4, as described further below.

The housing 2 is here illustrated as a tubular member having circumferentially spaced ears 11 extending from an exterior surface thereof and adapted to be received in corresponding recesses (not shown) in suitable structures, such as lock plates, to prevent turning of the housing relative thereto. The interior surface of the housing 2 has, in this example, an elongated ramp 12 (FIG. 2) extending inwardly from the entrance thereof and shaped to guide a barrel keeper 14 into retained position, although it is to be understood that any suitable means of rotatably retaining the barrel 3 in the housing 2 may be utilized. The ramp 12 terminates at a shoulder 13 engageable by the barrel keeper 14. The housing 2, in this example, is formed of material which will elastically deform during movement of the barrel keeper 14 along the ramp 12.

The interior surface of the housing 2 also has diametrically opposed slots or recesses 15 and 16 (FIG. 5) adapted to receive respective opposite end portions of the tumblers 4 when the barrel 3 is in rotatably aligned position within the housing 2. The recesses 15 and 16 are partially formed from end walls 17 and 18 respectively opposed to the shoulder 13, FIG. 4. The barrel 3 is rotatable within the housing 2 when each of the tumblers 4 are in an unlocked position as best illustrated in FIGS. 4 and 6. The tumbler slot 5 is non-compartmented, i.e., generally unobstructed in absence of the tumblers 4, and extends centrally longitudinally within the barrel 3, further having an entrance 19 at one end thereof to receive the key 10.

Figure 7:
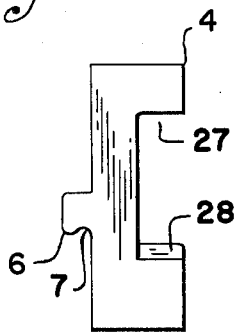
FIG. 7 is a front elevational view of one tumbler.
Figure 8:
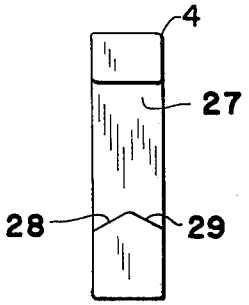
FIG. 8 is a side elevational view of the tumbler.
Figure 11:
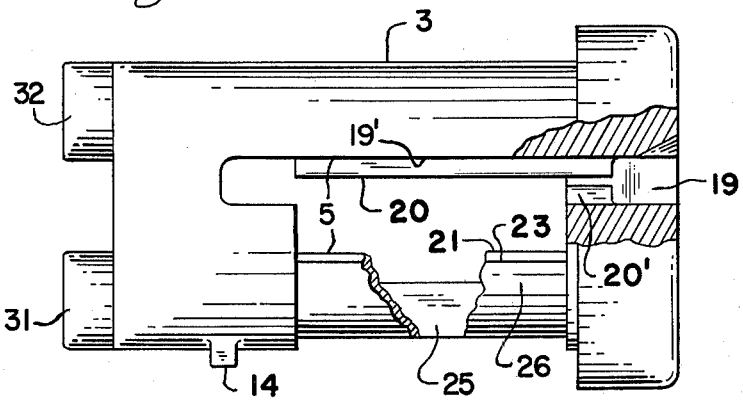
FIG. 11 is a top plan view of the barrel with parts broken away to reveal internal structure including an interrupted key guide projection.

One of the side walls 19' (FIGS. 2 and 11) defining the tumbler slot 5 has an interrupted projection 20 extending therealong and forming a key guide adapted for receipt into a longitudinally extending groove in one side of the key 10. The interrupted projection 20 provides spaced slots **20*a* (FIG. 11) therealong adapted to transversely receive guide projections 20*b* (FIGS. 7, 8 and 18) located on ends 20*c* of the respective tumblers 4 and of narrower width than the tumbler as best seen in FIGS. 8 and 18. Upon assembly of the tumblers 4 with the barrel 3, the ends 20*c* are urged into the tumbler slot 5, from below as viewed in FIG. 5, and the ends 20*c* move past the projection 20 by the transmission of the projections 20*b* through the slots 20*a*. Thus, the tumblers 4 can substantially "fill" the slot 5 to provide close sliding support to each other and against the walls forming the tumbler slot 5 while permitting a key guide projection (such as projection 20) in the key receiving slot, as described more fully below. A shorter key guide 20' is positioned only at the key entrance 19. The other side wall 21 of the slot 5, in this example, is partially absent, forming an elongated notch 22 adapted to movably receive the projections 6 of the tumblers 4. A recess 23 (FIG. 5), also adjacent the side wall 21, is adapted to receive, hooked thereon, one end of the resilient member 8**.

The barrel 3 forms radially extending, spaced-apart, surfaces 24 and 25 defining a slot 25' therebetween receiving the resilient member fingers or arms 9 therethrough for engagement with the respective tumbler projections 6 at the recesses 7. The resilient member arms 9 bend about an exterior curved barrel surface 26 of smaller radius than the barrel surface engaging the interior of the housing 2, providing suitable arm clearance therebetween. A tumbler projection 26' is spaced downwardly from the projection 6, as viewed in FIG. 7, and forms a sliding bearing surface against the lower inner wall 22' formed by the notch 22. Thus, the tumblers 4 are restricted against substantial movement in any direction except sliding movement vertically as viewed in FIGS. 4, 5 and 6.

As noted above, the barrel 3 may be secured in the housing 2 in any suitable manner, however, in the example of FIG. 2 the keeper 14 is urged along the ramp 12, slightly elastically deforming the housing 2, until it is beyond the shoulder 13, which then prevents the barrel from being withdrawn, without interfering with relative rotation.

The tumblers 4 are illustrated grouped together in mutually face to face relation whereby, as noted above, they slidably contact and support each other. The tumblers are characterized, in this example, as "C" shaped with an open side creating an open slot or recess 27, permitting ease of fabrication by conventional diecasting methods. Recesses 27, in the lock assembly, align with the barrel entrance 19 and contain an elongated portion of the interrupted key guide projection 20, creating a path or keyway for insertion of the key 10. The tumblers 4 exhibit inclined surfaces 28 and 29 within the recess 27 and extending transversely to the keyway. The surfaces 28 and 29 are adapted to engage portions of the key 10 for effecting movement of the respective tumbler between locked position and unlocked position as noted.

Figure 6:
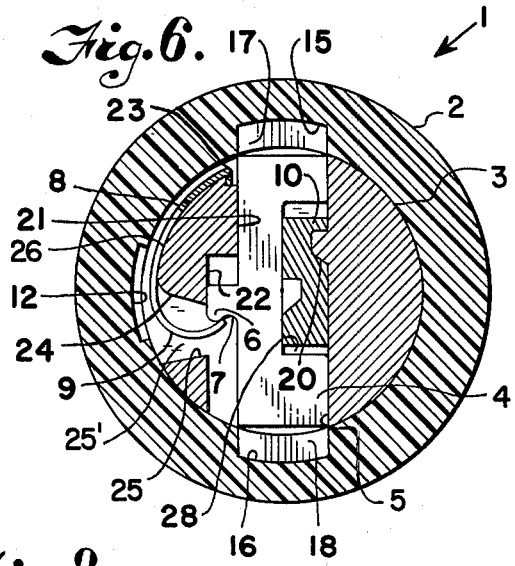
FIG. 6 is a transverse sectional view similar to FIG. 5 showing tumblers in unlocked positions.
Figure 10:
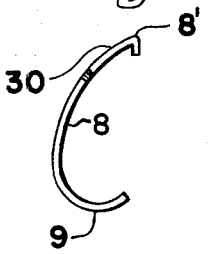
FIG. 10 is an end elevational view of the resilient member after being so formed.
Figure 9:
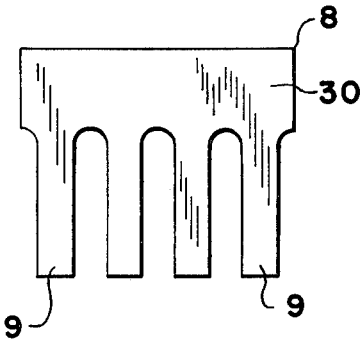
FIG. 9 is a front elevational view of a resilient member prior to being formed to operative shape.

The resilient member 8, shown prior to bending in FIG. 9, includes a continuous portion or bar 30 having one edge thereof at 8' formed into a hook shape (FIG. 10) for anchoring in the recess 23 (FIG. 5). The fingers or arms 9 extend laterally in spaced relation from the bar 30 and, after bending (FIG. 10), project arcuately through the slot 25' into respective engagement with the recess 7 of the tumbler projections 6, urging the tumblers resiliently upwardly, as viewed in FIG. 5.

In using a lock assembly constructed as illustrated and described, the key 10 is inserted through key entrance 19 and along the keyway defined by the tumbler recesses 27. The key guide projection 20 not only tends to block insertion of any object except the proper key, but engages the key along a substantial portion of its length to resist movement thereof vertically as viewed in FIGS. 4 and 6, thereby positively displacing the tumblers 4 to unlocked position (FIG. 6) as determined by key contact with the tumbler surfaces 28 and 29. The shorter key guide 20' serves the same functions as the projection 20, but is less effective since it does not extend substantially into the tumbler keyway. The proper displacement of the tumblers 4 causes their withdrawal from the housing recesses 15 without excess movement into the recesses 16, permitting the barrel 3 to be rotated within the housing 2. This causes suitable linkage (not shown) normally engaging barrel studs 31 and 32 to be moved, effecting a desired result, such as operating switch contacts, unlocking a door, etc.

An alternate structure for retaining the barrel in the housing is illustrated in FIGS. 12–14, which takes advantage of the fact that, in many applications the item to be locked limits the rotation of the barrel to a predetermined angle from a starting position, for example, 60°. In this embodiment a fixed barrel keeper 33 on the barrel 33' is received in an elongated housing slot 34 which takes the place of the ramp 12 in the first described structure. The slot 34 opens into a circular shoulder segment 35 of over 100° which blocks the withdrawal of the barrel unless the keeper 33 is aligned with the slot 34.

After assembly into the item to be locked (not shown) the lock is operated between the 60° limits shown in FIG. 14, thus effectively preventing disassembly by not allowing alignment with the slot 34. This structure is simpler and less expensive than the spring loaded keepers commonly used in lock assemblies and permits easy one-step fabrication, for example, by diecasting.

FIGS. 15, 16 and 17 disclose a modified form of this invention which includes a resiliently displaceable dust door 40. A cavity 41 is cast into the head 42 simultaneously with the formation of the arm receiving slot 43 corresponding to the slot 25′ discussed above. The cavity 41 is positioned somewhat rearwardly of the front surface 44, defining an integral front retaining wall or plate 45 which covers the cavity 41 and door 40, except for the portions exposed by the key entrance opening 46.

The door 40 is resiliently urged into key entrance blocking position, in this example, by an integral extension 47 of the multi-armed resilient member 48. The extension 47 forms an additional finger or arm 49 which curves into the cavity 41 and contacts the door 40. A key ramp 50 is preferrably formed in the front surface 44 with the key entrance opening 46 to aid in guiding the key against the closing edge 51 of the door, to urge same to an open position as shown in FIG. 17 upon key insertion.

Figure 19:
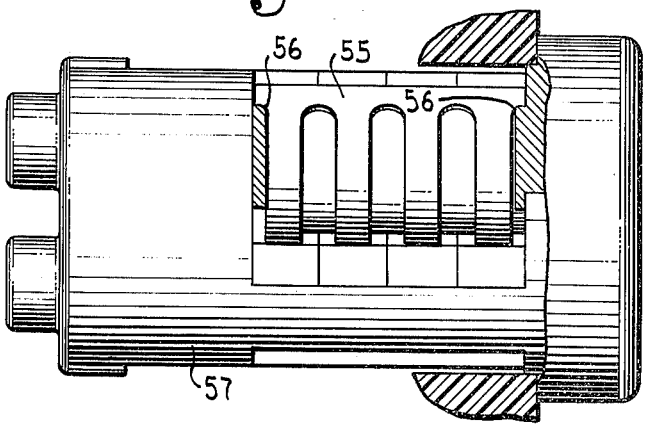
FIG. 19 is a side elevational view of a modified form of lock assembly wherein the resilient member is retained in position by longitudinally projecting shoulders.
Figure 21:
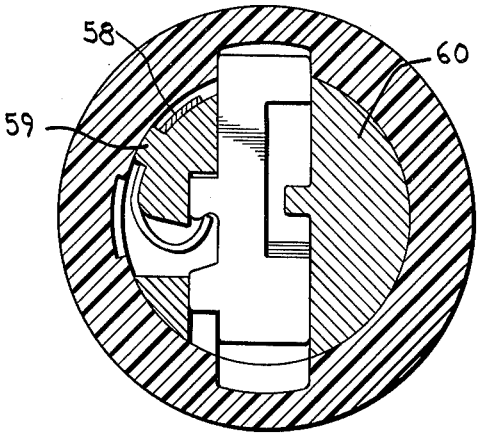
FIG. 21 is a transverse sectional view of a modified form of lock assembly wherein the resilient member is retained by projecting bosses.
Figure 23:
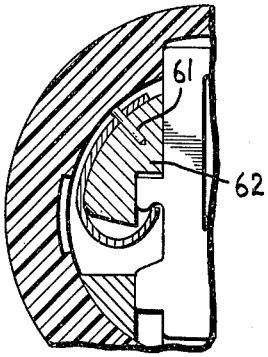
FIG. 23 is a fragmentary transverse sectional view similar to FIG. 21 but showing a modified form wherein the resilient member is retained by pins.
Figure 20:
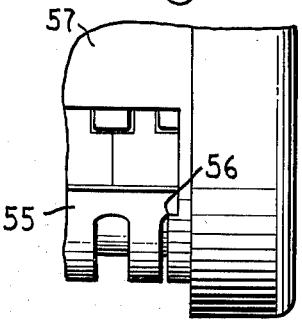
FIG. 20 is a fragmentary top plan view showing the modified form of FIG. 19.
Figure 22:
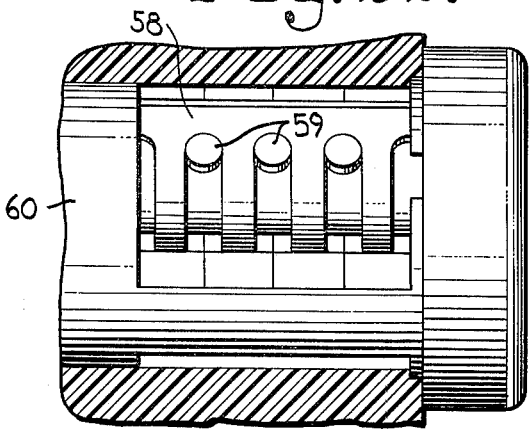
FIG. 22 is a fragmentary side elevational view of the modified form shown in FIG. 21.

FIGS. 19 and 20 disclose a modified form wherein the resilient member 55 is retained by shoulders 56 cast into the barrel 57. FIGS. 21 and 22 show a further alternate retainer for the resilient member 58 in the form of projecting bosses 59 integrally formed while casting the barrel 60. FIGS. 23 illustrates a still further alternate resilient member retainer in the form of pins 61 inserted into the barrel 62.

It is to be understood that while certain forms of this invention have been illustrated and described, it is not to be limited to the specific forms or arrangement of parts herein described and shown except insofar as such limitations are included in the following claims.

What I claim and desire to secure by Letters Patent is:

1. A lock assembly comprising:
a. a housing having a bore therein,
b. a barrel rotatably received in said bore,
c. walls in said barrel defining a tumbler slot,
d. a plurality of key receiving tumblers in said tumbler slot and respectively positioned in face to face sliding relation with at least one adjacent tumbler; said tumblers substantially filling said tumbler slot and at least partially defining a key receiving slot, said tumblers being generally "C" shaped whereby said key receiving slot is open sided,
e. a key guide projecting from one of said barrel walls and extending along and within said key receiving slot, interruptions positioned along said key guide, providing relief for insertion of said tumblers into said barrel past said key guide, and
f. resilient means contacting said barrel and having arms resiliently engaging said tumblers.

2. A lock assembly as set forth in claim 1 wherein:
a. said tumblers include a guide projection on one end thereof,
b. said tumbler guide projection being narrower in width than the width of said tumbler and transversely slidable through said key guide interruptions.

3. A lock assembly as set forth in claim 1 wherein:
a. said tumbler slot is generally unobstructed in absence of said tumblers.

4. A lock assembly as set forth in claim 1 wherein:
a. said resilient means is a unitary spring and said arms are curved.

5. The lock assembly as set forth in claim 4 including:
a. a hook shaped edge on said spring and engaging said barrel and retaining said spring in operational position.

6. The lock assembly as set forth in claim 4 including:
a. integral bosses projecting from said barrel and engaging said spring and retaining said spring in operational position.

7. The lock assembly as set forth in claim 4 including:
a. pins extending through said spring and into said barrel and retaining said spring in operational position.

8. The lock assembly as set forth in claim 4 including:
a. integral shoulders projecting from said barrel and engaging said spring and retaining said spring in operational position.

9. A lock assembly as set forth in claim 1 wherein:
a. said barrel has a generally radial slot communicating with said tumbler slot and through which said arms project into contact with said tumblers.

10. A lock assembly comprising:
a. a tubular housing,
b. a barrel rotatably received in said housing, said barrel having opposite ends, a tumbler slot intermediate said ends,
c. cooperating means on said housing and said barrel to rotatably retain said barrel in said housing,
d. a plurality of tumblers received in and substantially filling said tumbler slot and positioned in sliding engagement with at least one adjacent tumbler, said tumblers at least partially forming a key slot and each having a projection extending therefrom,
e. a key guide formed by said barrel and extending along and within said key slot, said key guide being interrupted providing relief for insertion of said tumblers into said tumbler slot past said key guide, and
f. a plurality of arms engaging said projections and urging said tumblers in a common direction.

11. A lock assembly as set forth in claim 10 including:
a. a bore in said housing and receiving said barrel therein, an elongated slot extending longitudinally in said bore, a shoulder formed by said housing and communicating with said slot, and
b. a fixed barrel keeper projecting from said barrel and slidable along said slot, said shoulder being positioned to block said keeper.

12. The lock assembly as set forth in claim 11 wherein:
a. said shoulder is in the form of a circular shoulder segment.

13. The lock assembly as set forth in claim 11 wherein:
a. said shoulder blocks said keeper except when said keeper is aligned with said slot.

14. A multiple tumbler cylinder lock as set forth in claim 10 including:
a. a dust door normally closing said key slot,
b. said plurality of arms comprising a unitary spring, and
c. said unitary spring including an additional arm engaging said dust door and resiliently urging same to a closed position.

15. The structure as set forth in claim 14 wherein:
a. said barrel forms a front plate retaining said dust door.

* * * * *